US007215918B1

(12) United States Patent
LeRoy

(10) Patent No.: US 7,215,918 B1
(45) Date of Patent: May 8, 2007

(54) FUSER ROLLER WITH IMPROVED CRACK RESISTANCE

(75) Inventor: Steven Robert LeRoy, Hilton, NY (US)

(73) Assignee: Xerox Corporation, Stam ( * ) Notice: Subject to any disclaimer, the term of this patent is extended or adjusted under 35 U.S.C. 154(b) by 0 days.

(21) Appl. No.: 11/346,778

(22) Filed: Feb. 2, 2006

(51) Int. Cl.
*G03G 15/20* (2006.01)

(52) U.S. Cl. ..... 399/333; 399/320

(58) Field of Classification Search ..... 399/333, 399/330, 328, 320
See application file for complete search history.

(56) References Cited

U.S. PATENT DOCUMENTS 4,780,078 A * 10/1988 Masui ..... 432/60
4,952,782 A * 8/1990 Yokokawa et al. ..... 219/469
2003/0044204 A1* 3/2003 Lee ..... 399/330

FOREIGN PATENT DOCUMENTS

JP 63293575 A * 11/1988
JP 09269691 A * 10/1997
JP 09281834 A * 10/1997

* cited by examiner

*Primary Examiner*—David M. Gray
*Assistant Examiner*—Bryan Ready
(74) *Attorney, Agent, or Firm*—James J. Ralabate

(57) ABSTRACT

This is a fuser roll having a driver slot having a large rounded upper portion to reduce cracking caused by drive load stresses. Around the slot is a reinforcing driver yoke to add additional resistance to cracking. Two reinforcing lugs can be used in place of the driver yoke.

4 Claims, 6 Drawing Sheets

FUSER ROLLER WITH IMPROVED CRACK RESISTANCE

FIELD

This invention relates, generally, to image-forming machines and methods and, more specifically, to the fusing systems in an electrophotographic reproduction machine.

BACKGROUND

Electrophotographic image-forming machines are used to transfer images onto paper or other medium in both printing and facsimile systems. Generally, a photoconductor is selectively charged and optically exposed to form an electrostatic latent image on the surface. Toner is deposited onto the charged photoconductor surface. The toner has a charge, thus it will adhere to the photoconductor surface in areas corresponding to the electrostatic latent image. The toner image is transferred to the paper or other medium. The toned paper is heated by a fuser roller system for the toner to fuse to the paper. The photoconductor is then refreshed—cleaned to remove any residual toner and charge—to make it ready for another image. The imaged paper is then passed to a document output collection area or tray where the user collects the finished, permanently imaged paper or documents.

The fuser rolls used in these image-forming systems are usually driven by a keyed hub that rides in a slot at the end of the fuser roll. The key drives the fuser roll which is made up of an aluminum core and a coating such as Teflon® (a trademark of DuPont); sometimes a small stainless steel limit stop is attached to the slot. When the key drives the fuser roll, it transfers the load to the fuser roll core causing it to rotate. Cracks forming after extended use in the fuser roll have been frequently experienced which eventually reduces the useful fuser roll life and requires replacement. After some investigation, it has been found that this cracking initially occurs in the upper region of the drive slot primarily because of the substantial load transferred to the fuser core slot during rotation and subsequent frequent braking of the fuser roll.

This cracking at the fuser roll slot which occurs in all sizes of fuser rolls has become a significant problem and results in frequent fuser roll replacement. It is not uncommon for fuser rolls to be recoated with Teflon® (or other coating) after the initial coating is worn or damaged. Sometimes this coating is replaced on the same fuser roll core two or three times. Extending the useful life of the relatively expensive core has become a high priority since cost effectiveness is always a concern. The load placed on the slot by the drive key with sudden stopping of the rotation plus the sometimes high temperatures used during fusing have accelerated the formation of cracks and deterioration of the core around the slot. Also it has been determined that the relatively small dimensions of the prior art slots in fuser rolls makes the cracks caused by stress more likely to occur.

SUMMARY

It has now been found that if the drive slot is machined with larger dimensions (or radii) this will help reduce points of stress concentration. Also in an embodiment, replacing the prior art stainless steel limit stop with a stainless steel drive yoke will further reduce these points of stress or load. This yoke transmits the drive load over a larger area and also transmits the braking load over a larger area when the roll is stopped. These improved embodiments will eliminate the cracking and breaking experienced in the existing fuser roll designs, thereby increasing fuser roll life and preventing ultimate damage to the fuser roll drive mechanism.

In an embodiment, the prior art slots are increased at least 1½ times their original dimensions. The terms "larger", "enlarged" or "expanded" slot size means a slot increased at least 1½ times that size of the original standard or currently used fuser roll slots up to a suitable effective size. A specific numerical increase is difficult to define since several varied size of fuser rolls are used; some are about ten (10) inches long and others extend to about 24 inches long. The normal or standard prior art slot, for example, in the fuser rolls that are about 24 inches long are about ⅝ inch long and about 5/16 inch wide. Expanding this slot in several rolls of an embodiment to about 1 inch long and about ⅜ inch wide has significantly reduced the cracking experienced in prior art slots. A key, therefore, is to expand the seat at least about 1½ times its original or standard dimensions in all size fuser rolls to transmit the drive and braking load over a larger area. The upper limit of expansion is any suitable size that effectively reduces or eliminates cracking around the slots. This larger radius or larger dimensions will provide additional stress relief to this slot area of the fuser roll that is prone to cracking and fractures. This increase of at least 1½ the original slot dimensions will distribute the load forces along a wider surface area and will reduce stress points. Also in all embodiments, it is important that the slot be machined so that rounded contours are provided on the closed portion of the slot. As used herein "rounded" portion or end includes inverted U-shaped slots, inverted key hole slots and other forms where the slot end (opposite the slot opening end) is rounded. This will provide stress relief over prior art cornered slots.

The larger slot, together with either or both: A. a wraparound yoke and B. at least two lugs on both sides of the slot (as shown in the drawings) significantly reduces cracking of the drive slot of fuser rolls.

Another embodiment combines a larger slot with a stainless steel (or other suitable) wraparound drive yoke that contacts both sides of the drive slot. This yoke replaces the current stainless steel limit stop which in the prior art is fitted on one side of the drive slot. This combination of drive yoke with a larger dimension rounded slots will provide excellent stress relief to this vulnerable area of the fuser roll. The yoke in one embodiment will match the contour of the drive slot.

In other embodiments where cost is a primary consideration, limit stops or lugs are used on both sides of the expanded larger slot, one to apply the load to the roll for driving and the other to apply the load to the roll for braking.

The increased larger slots can be machined to be circular, keyhole shaped or any other suitable shape having a rounded end. Using slots and yokes absent corners is helpful in reducing and eliminating cracks. For example, inverted u-shaped slot and u-shaped yokes alone or in combination will provide excellent resistance to cracking. A u-shaped slot with an attached drive lug has also been found to provide excellent results. Keyhole slots and corresponding keyhole yokes have shown to provide maximum crack protection. This wraparound keyhole shaped yoke with a large radius of a rounded section which follows the substantial contour of a keyhole shaped slot has been shown to be very effective.

BRIEF DESCRIPTION OF THE DRAWINGS

FIG. 3A shows the machined slot ready to accept the drive yoke. FIG. 3B shows the machined slot depicted in FIG. 3A with the drive yoke installed.

FIG. 4A shows the machined slot ready to accept dual drive lugs. FIG. 4B shows the machined slot depicted in FIG. 4A with the dual drive lugs installed.

DETAILED DISCUSSION OF DRAWINGS AND PREFERRED EMBODIMENTS

Figure 1:
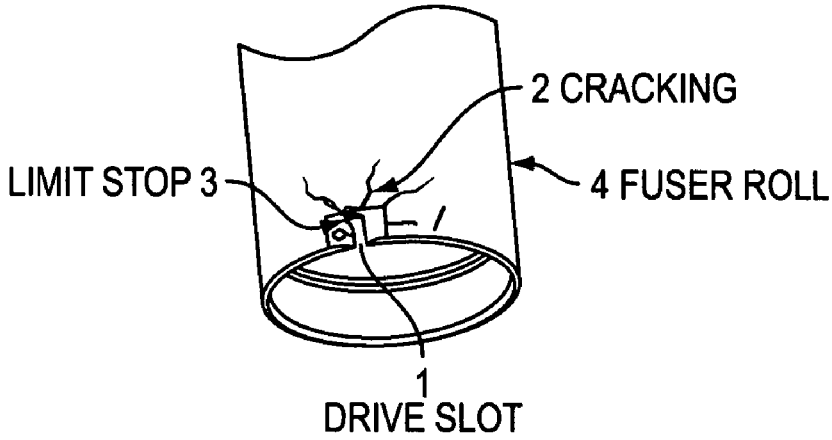
FIG. 1 PRIOR ART
FIG. 1 illustrates a prior art fuser roll having a conventional drive slot.

In FIG. 1 embodiment an existing prior art fuser roll smaller slot 1 is shown with cracks 2 which frequently occur in the prior art slots 1. A stainless steel limit stop 3 is shown attached to the outside of one side of slot 1 as presently used in existing or current fuser rolls 4. Cracking generally occurs in the region indicated in the drawing FIG. 1 sometimes on both sides of slot 1. These cracks have usually occurred at points of stress concentration caused by the drive load.

Figure 2:
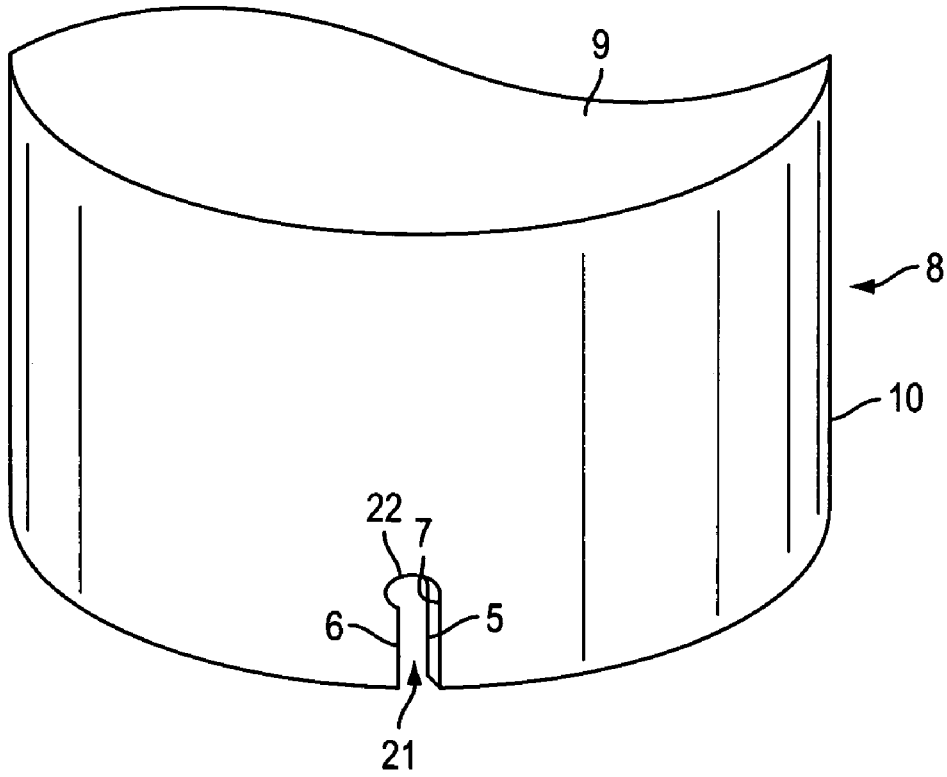
FIG. 2 illustrates an embodiment of the present invention where a larger and expanded slot is used in the fuser roll.

In FIG. 2 an embodiment of the present invention is shown whereby the enlarged slot 5 has dimensions substantially enlarged over the smaller prior art slot of FIG. 1. Notice the absence of sharp corners in enlarged slot 5 and the larger length 6 and radius of upper keyhole 7 with rounded section 22. The slot 5 is located at the end of fuser roll 8 which usually has an aluminum core 9 and a Teflon® (or rubber Teflon) coating 10. This enlarged drive slot 5 has been machined with a longer length 6 and a much larger radius 7 in rounded portion 22 to help reduce stress concentration to this area of the fuser roll 8 that is prone to cracking. On the end of the fuser roll opposite to the location of the driver slot 5 is an idler slot (not shown in drawings). This disclosure is concerned with the driver slot 5 since cracking occurs at this location and rarely at the idler slot location; however, the driver slot contour may also be used in the idler slot, if desirable.

Figure 3A:
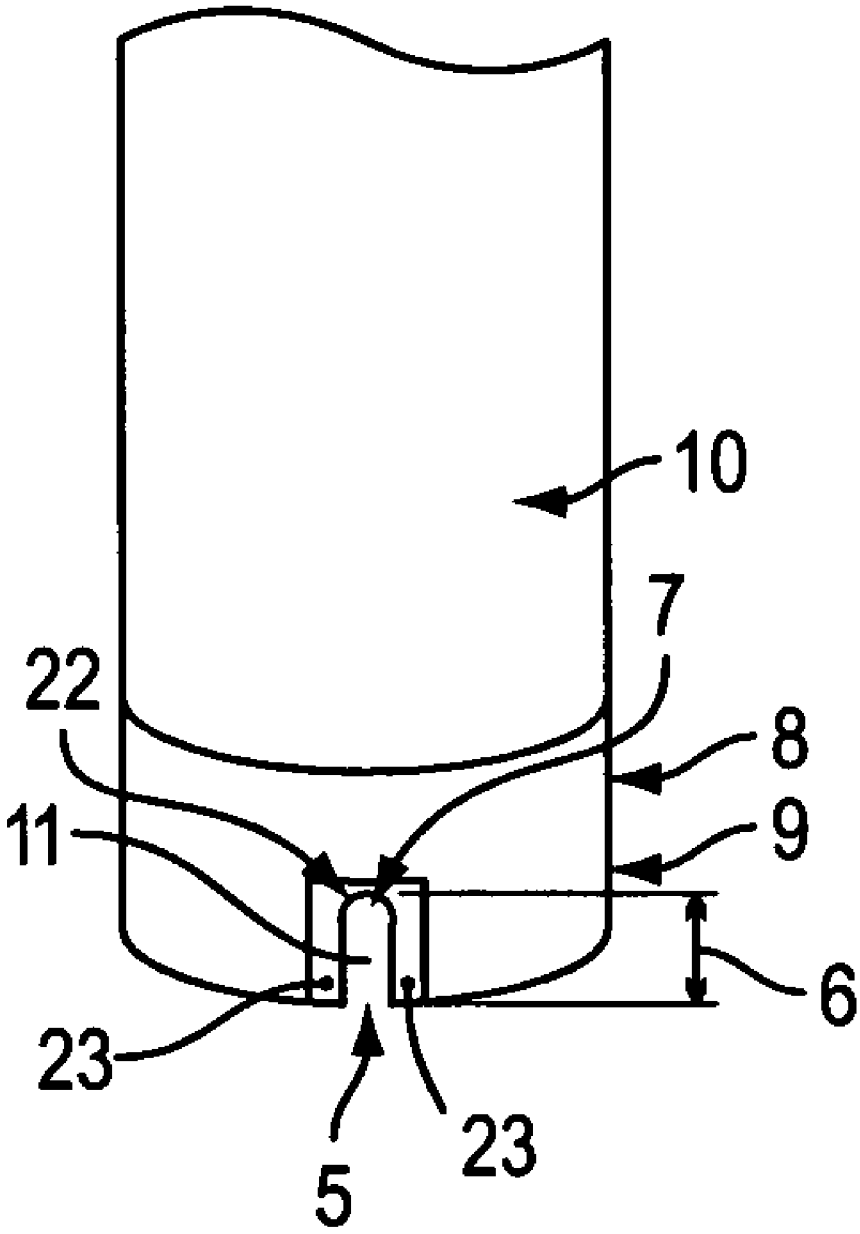
FIG. 3A illustrates an expanded unshaped slot with a wraparound yoke attached to it.
Figure 3B:
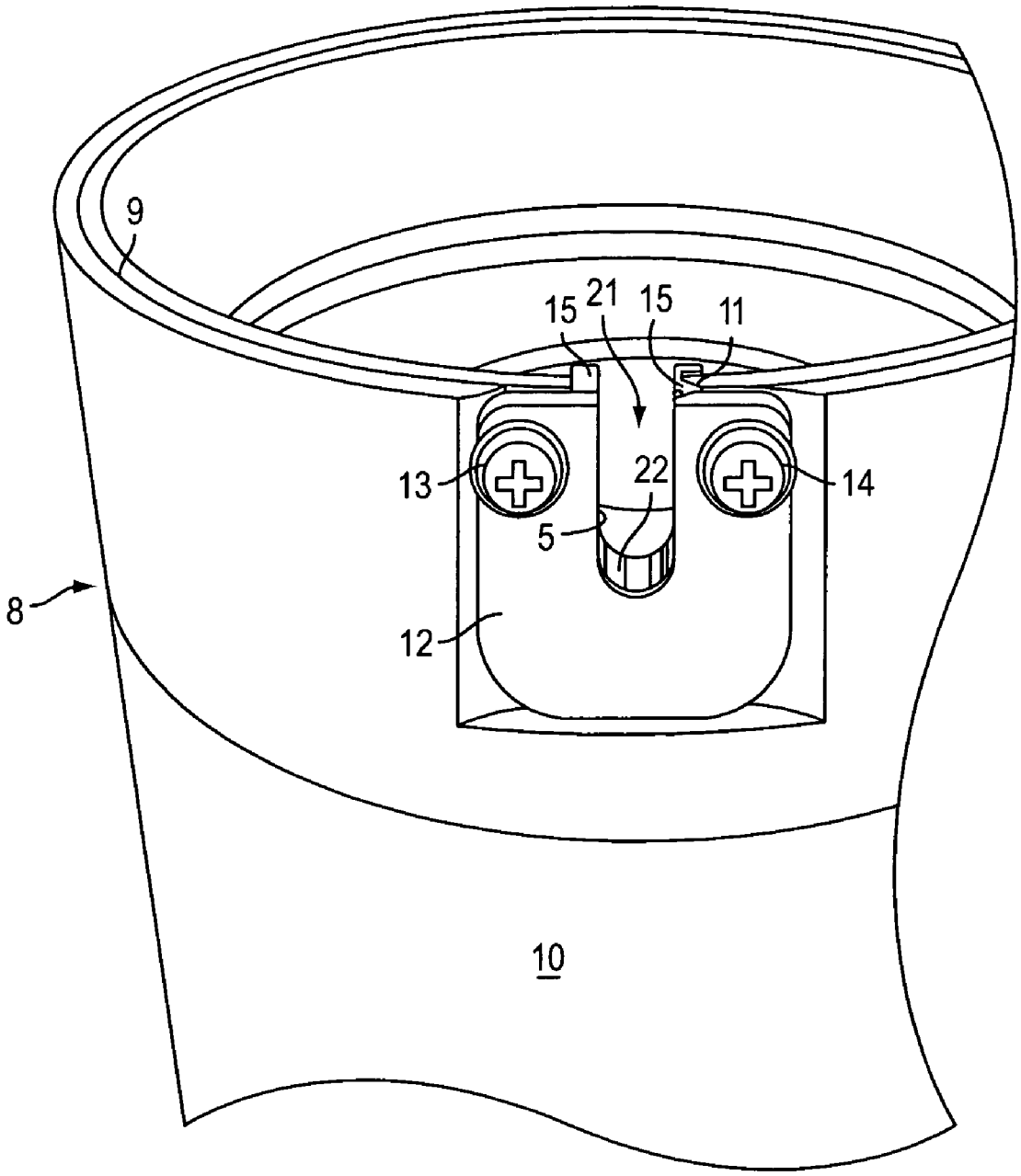
FIG. 3B illustrates an enlarged view of the fuser roll slot yoke design of FIG. 3A.

In FIGS. 3A and 3B an embodiment of an expanded u-shaped slot 11 with a wraparound yoke 12 attached thereto is shown. The reinforcing driver yoke 12 (FIG. 3B) that follows the contour of the slot 11 will substantially reduce cracking. In FIG. 3A, the slot 11 has two holes 23 for attachment of yoke 12 thereto. The yoke 12 transmits the drive load over a larger area and also transmits the braking load over a larger area when the fuser roll 8 is suddenly stopped. This improved drive and braking configuration will eliminate the cracking and breaking experienced in the prior art and existing designs, thus increasing fuser roll 8 life and preventing damage to the fuser roll drive mechanism. In FIG. 3B, the yoke 12 is attached with screws 13 and 14 to the area surrounding u-shaped slot 5 with an open end 21 and a rounded section 22 and extends inwardly with projections 15 to further strengthen the drive slot 11 which when in contact with a drive key will eliminate the cracking and life reduction of the fuser roll 8. As earlier noted, both the enlarged slot 5 and the yoke 12 alone or in combination both with a rounded portion 22 ensures an effective anti-cracking embodiment. The yoke 12 may be made from stainless steel or any other suitable material. Generally, core 9 is made from aluminum.

Figure 4A:
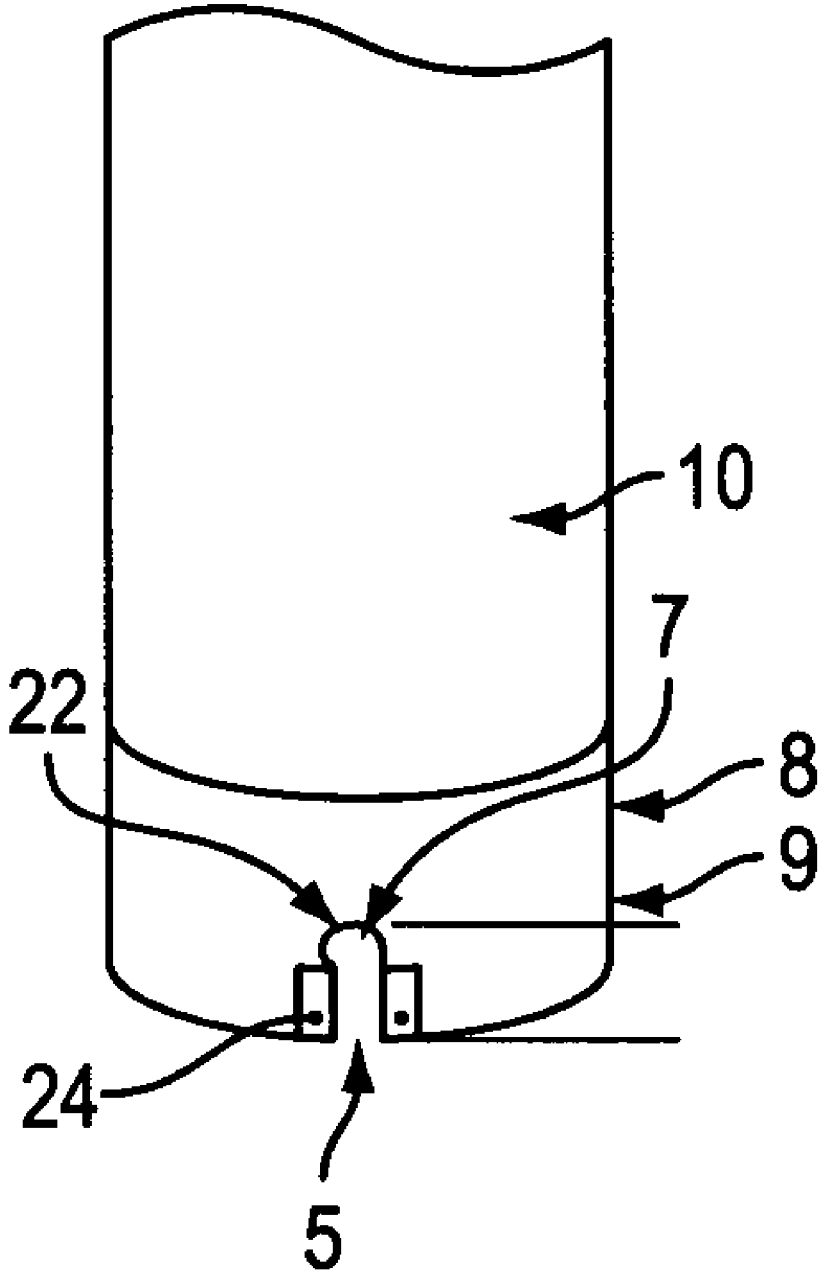
FIG. 4A illustrates a keyhole slot having outside supporting lugs connected thereto.
Figure 4B:
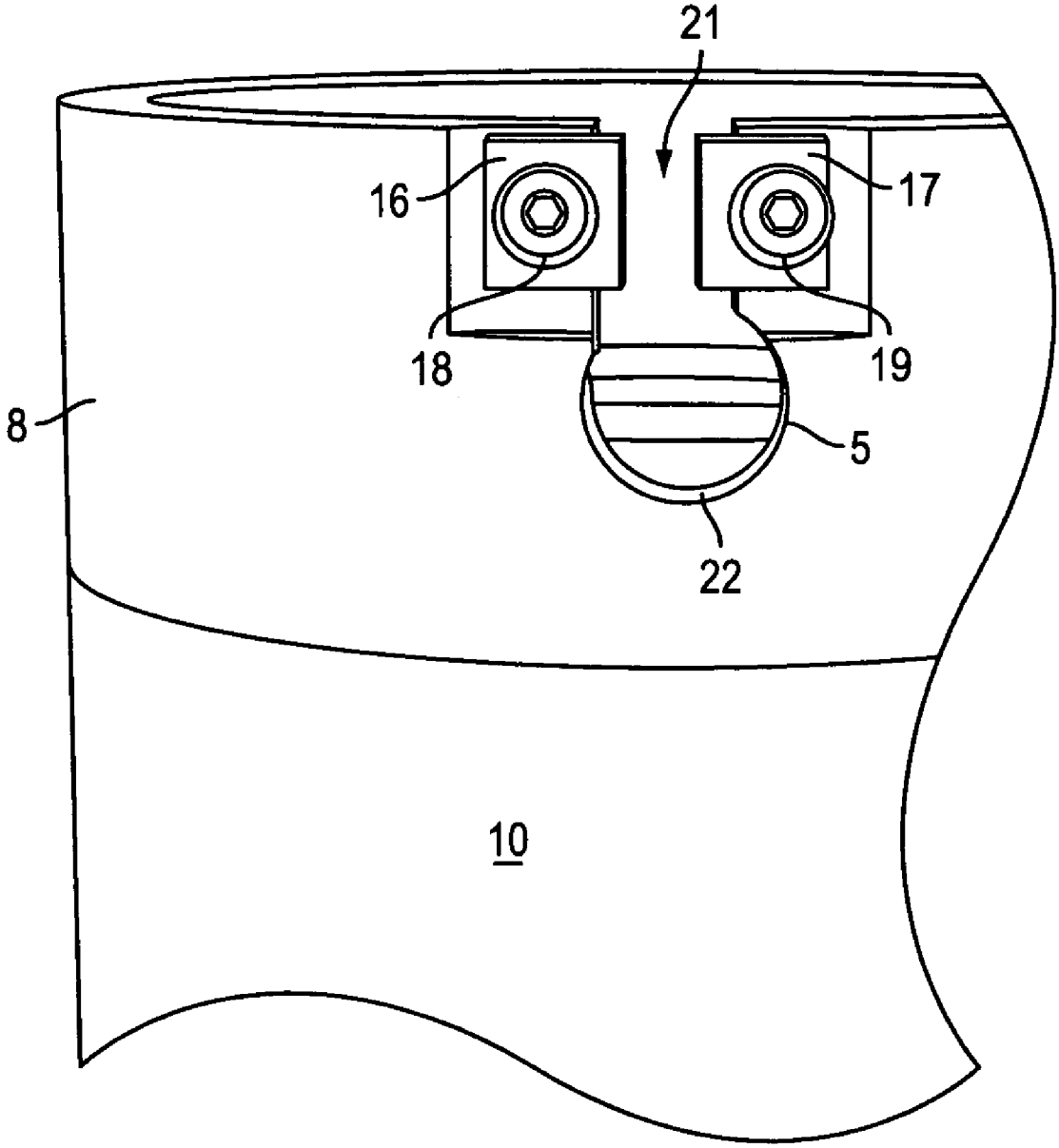
FIG. 4B illustrates an enlarged view of the fuser roll slot double lug design of the slot of FIG. 3A.
Figure 5:
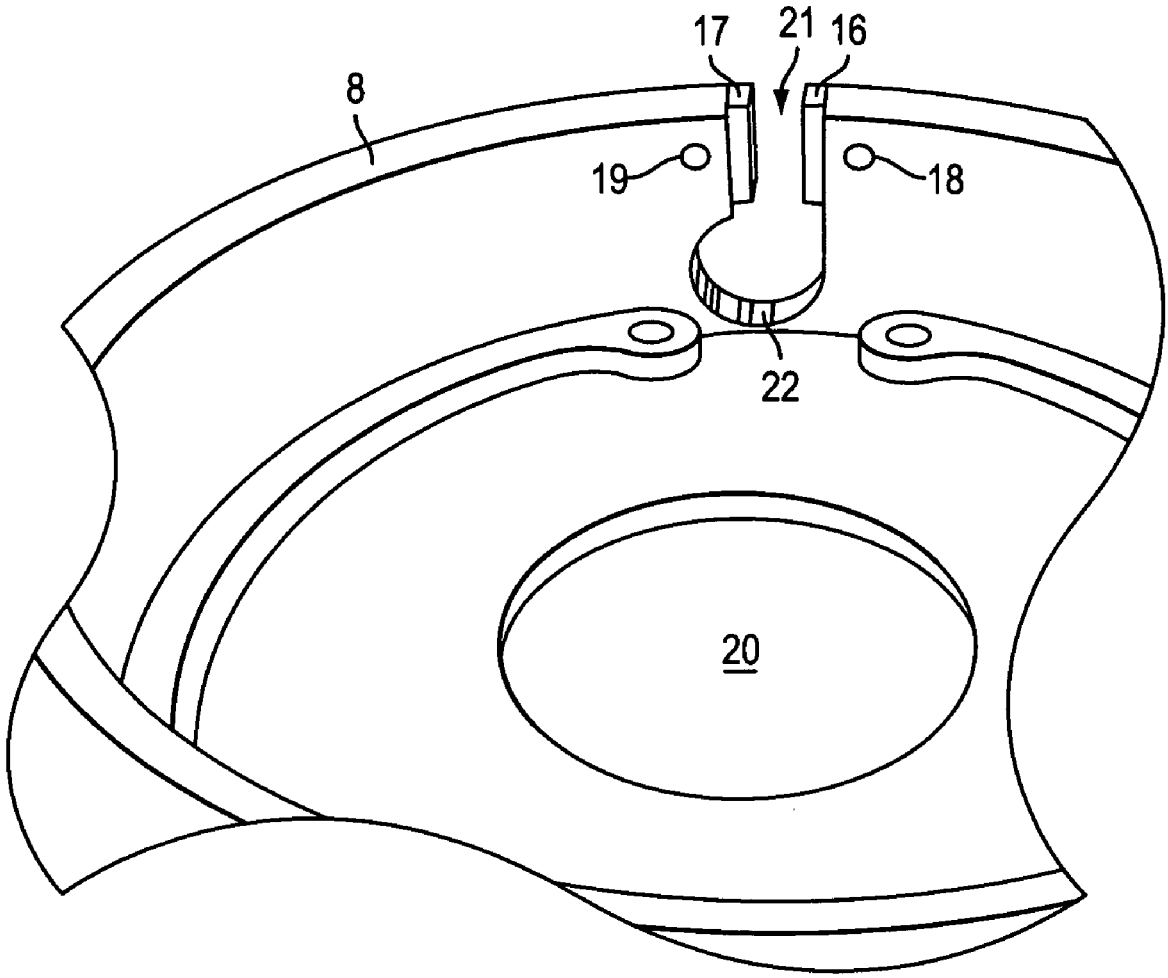
FIG. 5 illustrates the keyhole slot with dual drive lugs embodiment from an inner fuser roll view.

In FIGS. 4A and 4B an enlarged keyhole shaped slot 5 with a rounded portion 22 is reinforced by lugs 16 and 17 in FIG. 4B which are positioned at the upper section surrounding slot 5. In FIG. 4A, two holes 24 are shown for attachment of lugs 16 and 17. This configuration is one of the most economical yet effective embodiments. Here the inverted enlarged keyhole slot 5 is partially surrounded by lugs or holds 16 and 17 and connected thereto by screws 18 and 19. FIG. 4 illustrates this embodiment from the outside of fuser roll 8 while FIG. 5 illustrates this same embodiment from an inner view of fuser roll 8. Note that screws 18 and 19 extend through the thickness of fuser roll 8. The drive key fits through the interior 20 of the core of fuser roll 8. Slot 5 has an open end 21 and a closed end 22, the open end 21 being located at the farthest end portion of fuser roll 8.

All of the above described embodiments have a drive slot on one driver end of tubular shaped fuser roll 8, and an idler slot located on the opposite end of fuser roll 8. The above embodiments are obviously refer only to the drive slots; the idler slots are used to merely hold the fuser roller position. All of the above slots have on one end an open terminal end portion 21 for entrance of a fuser roll drive key and in the opposite end a rounded portion 22. The fuser roll 8 of the above embodiments is useful in toner fusing systems of any applicable marking system.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A tubular fuser roll for use in an electrostatic printing apparatus which comprises in an operative arrangement, a fuser roll tubular core, a fuser roll coating and an expanded or enlarged U-shaped or keyhole driver slot positioned at a driver end of said fuser roll, said fuser roll coating extending around a major portion of said fuser roll, said enlarged U-shaped driver slot adapted to be connected to a fuser roll drive mechanism and having connected thereto a reinforcing wraparound yoke attached to the area surrounding said slot by at least two screws or at least two screw-attached reinforcing lugs, said at least two lugs located on both sides of said slot, said driver slot having an expanded configuration including a rounded portion, said rounded portion located in said driver slot at a location nearest said fuser roll coating, said driver slot having an open end portion on an end opposite to that of said rounded portion, said slot and said rounded portion enabled to at least reduce cracking of fuser roll areas adjacent said slot, said enlarged driver slot having expanded dimensions equal to about at least 1½ the dimensions of its original dimensions, and wherein said enlarged drive slot having a configuration absent corner sections, but including rounded sections positioned in said slot at a slot end opposite to a slot open end.

2. The fuser roll of claim 1 wherein said lugs are used on both sides of said expanded slot, one lug enabled to apply a load to said roll for driving and the other lug to apply a load to said roll for braking.

3. The fuser roll of claim 1 wherein said slot and yoke are U-shaped.

4. The fuser roll of claim 1 wherein said slot and yoke are inverted keyhole shaped.

* * * * *